United States Patent [19]

Maas et al.

[11] Patent Number: 4,925,106

[45] Date of Patent: May 15, 1990

[54] FOAM-OFF NOZZLE ASSEMBLY WITH BARREL SCREEN INSERT FOR USE IN A TRIGGER SPRAYER

[75] Inventors: Wilhelmus J. J. Maas; Petrus L. W. Hurkmans, both of Someren, Netherlands

[73] Assignee: AFA Products, Inc., Forest City, N.C.

[21] Appl. No.: 251,163

[22] Filed: Sep. 29, 1988

Related U.S. Application Data

[63] Continuation-in-part of Ser. No. 181,143, Apr. 13, 1988, Pat. No. 4,890,792, which is a continuation-in-part of Ser. No. 158,329, Feb. 19, 1988, Pat. No. 4,883,227, which is a continuation of Ser. No. 817,935, Jan. 10, 1986, Pat. No. 4,730,775.

[51] Int. Cl.[5] ..... B05B 1/02; B05B 1/12; B05B 7/04

[52] U.S. Cl. ..... 239/333; 239/343; 239/428.5; 239/432; 239/504

[58] Field of Search ..... 239/71, 333, 343, 403, 239/428.5, 432, 487, 489, 498, 502, 504, 518, 524

[56] References Cited

U.S. PATENT DOCUMENTS

| | | | |
|---|---|---|---|
| D. 293,929 | 1/1988 | Verhees | D23/34 |
| 3,937,364 | 2/1976 | Wright | 222/190 |
| 3,946,947 | 3/1976 | Schneider | 239/401 |
| 4,013,228 | 3/1977 | Schneider | 239/401 |
| 4,027,789 | 6/1977 | Dickey | 222/190 |
| 4,072,252 | 2/1978 | Steyns et al. | 222/341 |
| 4,147,306 | 4/1979 | Bennett | 239/327 |
| 4,156,505 | 5/1979 | Bennett | 239/327 |
| 4,219,159 | 8/1980 | Wesner | 239/343 |
| 4,234,128 | 11/1980 | Quinn et al. | 239/478 |
| 4,350,298 | 9/1982 | Tada | 239/333 |
| 4,365,751 | 12/1982 | Saito et al. | 239/333 |
| 4,463,905 | 8/1984 | Stoesser et al. | 239/329 |
| 4,625,915 | 12/1986 | Cockman | 239/524 |

FOREIGN PATENT DOCUMENTS

| | | | |
|---|---|---|---|
| 0237696 | 9/1987 | European Pat. Off. | 239/343 |
| 50-58310 | 5/1975 | Japan . | |
| 56-133358 | 10/1981 | Japan . | |

*Primary Examiner*—Andres Kashnikow
*Assistant Examiner*—Karen B. Merritt
*Attorney, Agent, or Firm*—Thomas R. Vigil

[57] ABSTRACT

The foam nozzle assembly is mounted to a trigger sprayer and comprises an outer barrel portion defining a foam generating chamber into which liquid is ejected in a conical spray from an orifice in a back wall of the foam generating chamber. The cone of the spray subtends a predetermined angle. A perforated wall is located in the outer barrel portion and is spaced forwardly of the back wall having the orifice from which the conical spray is ejected. The perforated wall has ribs and slots therein and the back edges of the portions of the ribs between slots are rounded to provide a surface upon which the conical spray can infringe and be deflected in different directions to mix with air in the foam generating chamber to create foam. The rounded back edge of each of the ribs is defined by a generally circular round having a given radius R. Preferably, the width of each slot is defined as S and the radius R is in a ratio to the slot width S, R:S, of between approximately 1:2 and 1:4 and preferably 1:3.

29 Claims, 5 Drawing Sheets

FOAM-OFF NOZZLE ASSEMBLY WITH BARREL SCREEN INSERT FOR USE IN A TRIGGER SPRAYER

This application is a continuation-in-part of U.S. application Ser. No. 181,143, filed Apr. 13, 1988, for: NOZZLE ASSEMBLY, now U.S. Pat. No. 4,890,792, and is a continuation-in-part of U.S. application Ser. No. 158,329 filed Feb. 19, 1988 for: FOAMER NOZZLE ASSEMBLY WITH AIR PASSAGEWAY, now U.S. Pat. No. 4,883,227, which is a continuation of U.S. application Ser. No. 817,935 filed Jan. 10, 1986, for: TWO PIECE FOAMER NOZZLE ASSEMBLY, now U.S. Pat. No. 4,730,775.

BACKGROUND OF THE INVENTION

1. Field of the Invention

The present invention relates to a two position nozzle assembly which has a barrel screen insert and which is mounted on a trigger sprayer.

2. Description of the Prior Art

Heretofore various liquid foam dispensing devices have been proposed. For example, a foam dispensing device including a squeezable container with foaming member and valve system is disclosed in the Wright U.S. Pat. No. 3,937,364. Such device is, however, much different than, and non-analogus to, a trigger operated foam dispensing device.

Additionally, non-analogus vertical pump type foam dispensers have been proposed in the Dickey U.S. Pat. No. 4,027,789 and the Bennett U.S. Pat. Nos. 4,147,306 and 4,156,505.

Foam barrel generating devices are disclosed in Japanese published Utility Model, Publication No. 50-58310 and the Schneider U.S. Pat. No. 3,946,947.

One trigger operated foam dispensing device is disclosed in the Schneider U.S. Pat. No. 4,013,228. In this patent, a multi-section foam generating barrel with a pressure reducing inlet passageway is longitudinally adjustable relative to a diverging liquid stream for developing a desired foaming action.

Another trigger operated foam dispensing device utilizing an elongate barrel with several chambers therein separated by screens is disclosed in the Wesner U.S. Pat. No. 4,219,159.

Still another trigger operated foam dispensing device is disclosed in the Tada U.S. Pat. No. 4,350,298. In this patent, a trigger type foam dispensing device includes a nozzle cap with an outlet wall having a plurality of arms constituting an obstacle wall against which spray liquid from a spray or stream outlet orifice collides to mix with air in the nozzle cap to form foam which exits the nozzle cap through three or more orifices formed between the arms in the outlet wall.

A three position nozzle assembly providing a SPRAY position, a STREAM position, and an OFF position for use with a trigger operated liquid dispensing device is disclosed in the Quinn U.S. Pat. No. 4,234,128.

A further trigger operated foam dispensing device is disclosed in the Stoesser et al U.S. Pat. No. 4,463,905. In this patent, a foam forming structure is formed at the outlet of a trigger operated liquid dispensing device. The structure includes an orifice in an outlet wall on the body of the dispensing device, a short axial length cylindrical chamber in front of (or downstream of) the orifice and a screen over the downstream end of the chamber. The conical spray pattern from the orifice is designed to impinge on the screen in a circle pattern smaller than the circular outer edge of the screen so that air, for mixing with the spray to form foam, can enter the chamber through the screen in the annular area between the circle spray pattern and the circular outer edge of the screen.

A two position nozzle assembly without a barrel screen insert is disclosed in the Japanese Utility Model Laid Open Publication No. 133358/1981 and the design of a two position nozzle assembly without a barrel screen insert but otherwise similar to the two position nozzle assembly disclosed herein is disclosed in U.S. Des. 293,929 the disclosure of which is incorporated herein by reference.

Trigger sprayers of the type which are adapted to mount the two position nozzle assembly with a barrel screen insert are disclosed in the Steyns et al U.S. Pat. No. 4,072,252 and the Saito etal U.S. Pat. No. 4,365,751, the disclosures of which are incorporated herein by reference.

As will be described in greater detail hereinafter, the foam nozzle assembly of the present invention differs from the previous foam nozzle assemblies used in, or combined with, a trigger sprayer by not only providing a foam nozzle assembly having a simple two piece construction including an integral one piece nose bushing which is received in an opening at the upper forward end of the body of a conventional trigger operated liquid dispensing device and an integral one piece nozzle member which is received over and mounted on an outlet end portion of the nose bushing, but in addition a barrel screen insert mounted in a foam generating chamber in an outer short barrel of the nozzle member.

The nose bushing outlet end portion has a construction including at least two tangential passageways which permit liquid to enter a central cavity tangentially of the cavity so that a swirl of liquid is provided in the cavity. The nose member includes the short barrel portion, a cap portion which is received over the bushing outlet end portion where it can communicate with the cavity and an inside wall defining on one side, a bottom wall of the cap portion, and on the other side, an inner end wall of the short barrel portion. The inside wall has an orifice and the barrel portion has air inlet openings extending through the barrel portion near the inside wall. The barrel insert is a generally hollow insert having a perforated interior wall.

Swirling liquid from the cavity at the outlet end of the nose bushing communicates, in one position of the nozzle member, with the orifice and a conical spray of liquid created by the swirling liquid exiting from the orifice, impinges on the perforated wall and mixes with air received in the barrel portion from the air inlet openings to create foam which is dispensed from an outer chamber in the outer end of the barrel screen insert.

The nozzle member is movable between a FOAM position where the tangential passageways are open to allow swirling fluid to be pumped out of the body of the trigger operated dispensing device and an OFF position where the tangential passageways are closed.

This application is a continuation-in-part of U.S. application Ser. No. 181,143 now U.S. Pat. No. 4,890,792, for the teaching therein of ribs which have a specifically configured back edge in a foamer nozzle assembly. The specific configuration taught in this patent is a V-shaped back edge. The disclosure of this patent is incorporated herein by reference.

This application is also a continuation-in-part application of U.S. application Ser. No. 158,329, now U.S. Pat. No. 4,883,227, which is a continuation of U.S. application Ser. No. 817,935 now U.S. Pat. No. 4,730,775 for the teaching therein of an outer piece having a Y shaped interior wall therein which is received in an inner piece in a manner analogous to the receiving of the barrel screen insert described herein within an outer barrel portion of a nozzle member. The disclosures of U.S. Pat. Nos. 4,730,775 and 4,883,227 are incorporated herein by reference.

SUMMARY OF THE INVENTION

According to the present invention there is provided a foam nozzle assembly mounted to a trigger sprayer and comprising an outer barrel portion defining a from generating chamber into which liquid is ejected in a conical spray from an orifice in a back wall of the foam generating chamber, the cone of the spray subtending a predetermined angle, a perforated wall which is located in the outer barrel portion and which is spaced forwardly of the back wall having the orifice from which the conical spray is ejected, the perforated wall having ribs and slots therein and the back edges of the portions of the ribs between slots being rounded to provide a surface upon which the conical spray can impinge and be deflected in different directions to mix with air in the foam generating chamber to create foam, the rounded back edge of each rib being defined by a generally circular round having a given radius R.

Preferably, according to the invention, the perforated wall has arcuate partially circular slot segments which define therebetween the outline of at least two intersecting equally arcuately spaced apart diameter ribs and at least two concentric circular ribs. Also, preferably, according to the invention, the back edges of the diameter ribs and circular ribs facing into the inner cavity are rounded so as to provide an irregular curved surface against which the spray of liquid can impinge and scatter to mix with air and form foam in the foam generating chamber and to provide a curving surface toward the outer chamber defining the foam accumulating chamber so that foam thus generated moves easily through the perforated wall into the outer cavity defining the foam accumulating chamber.

Additionally, according to one preferred embodiment, the rounded back edges are circular or cylindrical rounds having a radius and the radius has a ratio to the spacing across the arcuate partially circular slot segments (or between adjacent concentric circular ribs) of between 1:1 and 1:10, and preferably 1:3.

DESCRIPTION OF THE PREFERRED EMBODIMENT

Figure 1:
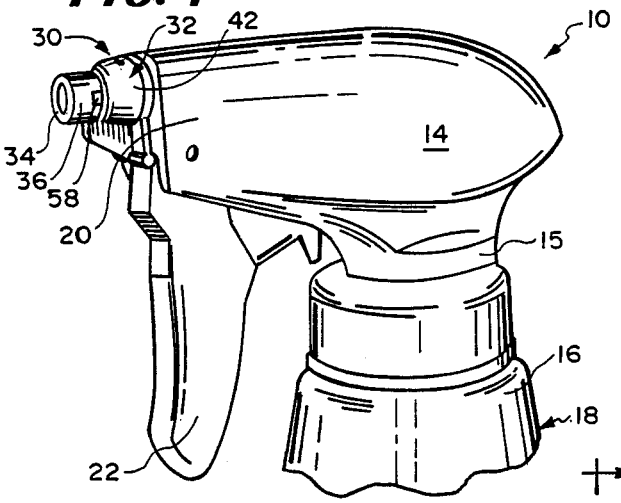
FIG. 1 is a perspective view of a foam nozzle assembly mounted on a conventional trigger operated liquid dispensing device.

Referring now to the drawings in greater detail, there is illustrated in FIG. 1 a trigger operated liquid dispensing device 10 which can have a body 14, an inlet opening (hidden from view) in a lower portion 15 of the body 14 communicating with a neck 16 of a container 18 and an outlet opening (hidden from view) in an upper forward end portion 20 of the body 14. A pumping system or mechanism (hidden from view) is mounted within the body 14 and is operated by a trigger 22 pivotally mounted to the body 14. The construction and operation of the trigger operated liquid dispensing device 10 briefly described above can be of the type disclosed in the Garneau U.S. Pat. No. 4,669,664, the disclosure of which is incorporated herein by reference.

As shown, a foam nozzle assembly 30 is mounted to the upper forward end 20 and includes a foam nozzle member 32 which is adapted to be rotated from an OFF position (shown in FIGS. 1 and 3) to a FOAM position (shown in phantom in FIG. 3) where pumping of liquid from the container 18 by squeezing the trigger 22 will result in the generation of foam in the nozzle member 32 and the dispensing of foam from an outlet end 34 of a short barrel portion 36 of the nozzle member 32.

Figure 2:
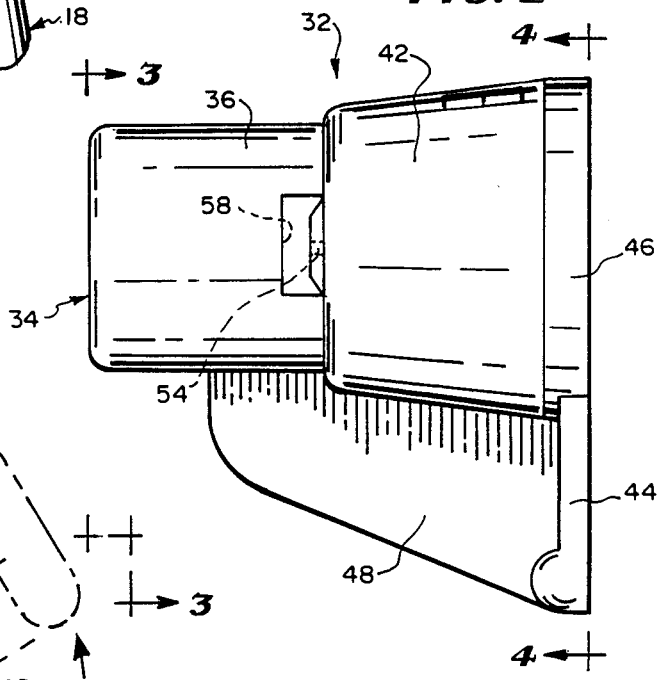
FIG. 2 is an enlarged side elevational view of a nozzle member of the foam nozzle assembly shown in FIG. 1.
Figure 11:
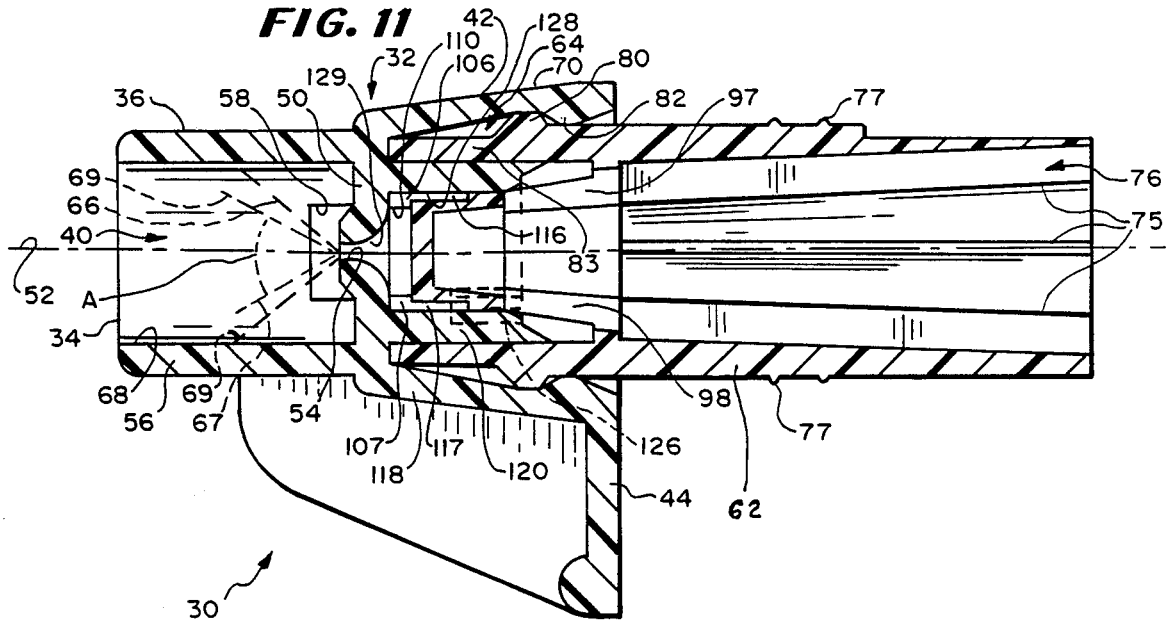
FIG. 11 is an longitudinal axial cross-sectional view of the foam nozzle assembly and shows the nozzle member mounted on an outlet end portion of the nose bushing.

As shown in FIG. 2, the nozzle member 32 includes the short barrel portion 36 which, as shown in FIG. 11, has a smooth generally cylindrical chamber 40 in which foam can be generated.

The nozzle member 32 further includes a cap portion 42. Depending from the cap portion 42 is a radial flange 44 which extends from and is integral with a rear margin 46 of the cap portion 42 and a thumb or finger engageable, axially extending, flange 48 which extends axially forwardly from the radially extending flange 44.

As best shown in FIG. 11, the nozzle member 32 has an inside wall 50 extending transversely of an elongate axis 52 of the nozzle member 32. An orifice 54 extends through the inside wall 50 and is coaxial with a longitudinal axis 52 of the nozzle member 32.

Still referring to FIG. 11, it will be apparent that the short barrel portion 36 is defined by a cylindrical wall 56 which has at least two air inlet openings 58 (FIGS. 1, 2, 3 and 11).

As shown in FIG. 11, the foam nozzle assembly 30 includes not only the nozzle member 32 but also a nose bushing 62 which has an outlet end portion 64 which is received in the cap portion 42. Stated otherwise, the cap portion is received over, and mounted on, the outlet end portion 64 of the nose bushing 62.

Figure 3:
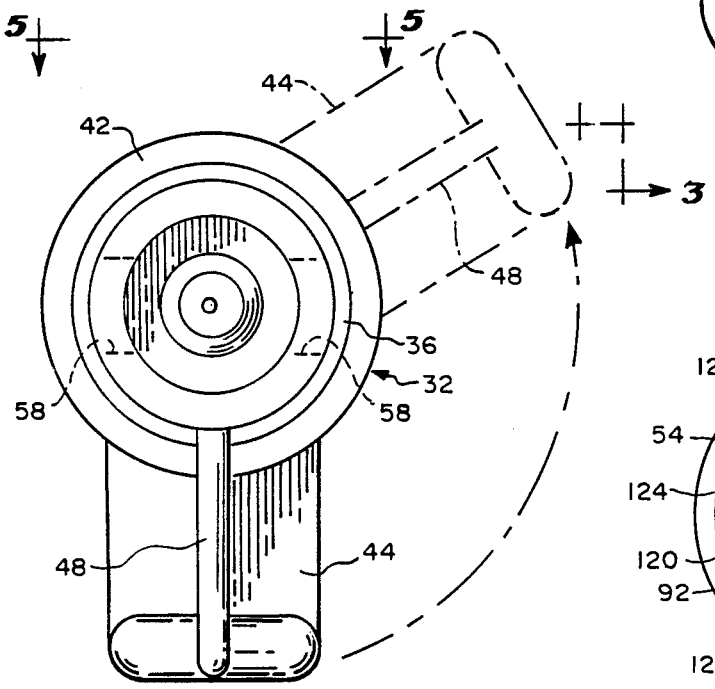
FIG. 3 is a front end view of the nozzle member shown in FIG. 2 and is taken along line 3—3 of FIG. 2.

With reference to FIG. 3, and as will be described in greater detail hereinafter, when the nozzle member 32 is in the position shown, flow of liquid from the nose bushing 62 to and through the nozzle 54 is blocked and the foam nozzle assembly 30 is in an OFF position. Then as will be described in greater detail hereinafter, when the nozzle member 32 is rotated to the position shown in phantom in FIG. 3, a flow path from the nose bushing 62 to the orifice 54 is open and swirling liquid passing through the orifice 54 will exit therefrom in a conical spray pattern, subtending an angle of approximately 60° and generally identified by dash lines 66 and 67 in FIG. 11, and impinge upon an inner surface 68, preferably cylindrical, of the wall 56, preferably cylindrical, of the short barrel portion 36 of the nozzle member 32 and mix with air from the air inlets 58 to generate foam. To enhance the generation of foam according to the teachings of the present invention, a barrel screen insert (160 in FIGS. 12–14) is received in the short barrel portion and has a foam generating chamber (182 in FIG. 12) in which the spray impinges upon a perforated wall (168 in FIGS. 12–14) and mixes with air to generate foam as will be described in greater detail hereinafter in connection with the description of FIGS. 12–14. For this preferred embodiment, a conical spray pattern 69 subtending an angle of approximately 40° is generated, as will be described in greater detail hereinafter.

Figure 5:
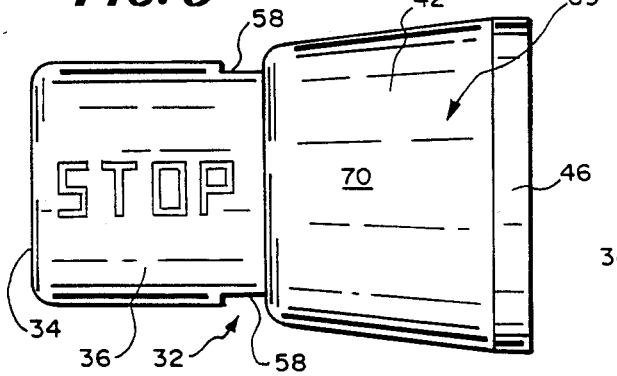
FIG. 5 is a top plan view of the nozzle member shown in FIG. 3 and is taken along line 5—5 of FIG. 3.
Figure 6:
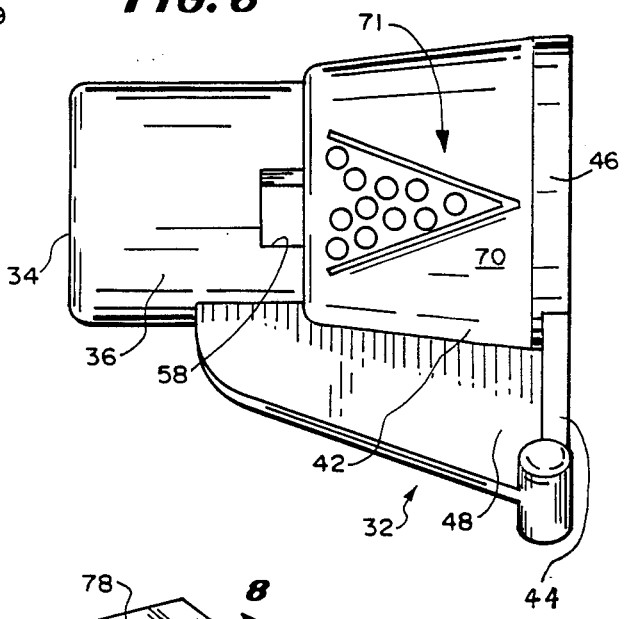
FIG. 6 is a top plan view similar to FIG. 5 but with the nozzle member rotated to the position shown in phantom in FIG. 3 and shows the FOAM position of the nozzle member.

Referring now to FIG. 5 (which is a top plan view of the nozzle member 32 in the position thereof shown in FIGS. 1, 2 and 3) it will be apparent that position indicia 69 in the form of the word "STOP" are provided on cylindrical outer surface 70 of the short barrel portion 36.

In a similar manner, foam indicating indicia 71 are provided on the cylindrical outer surface 72 of the cap portion 42 and such indicia 71 will be clearly seen in a top plan view of the nozzle member 32 when it is rotated to the position shown in phantom in FIG. 3. This indicia 71 is in the form of a design of a conical spray pattern and bubbles exiting from the conical spray pattern.

Referring now in more detail to FIGS. 7–11, the nose bushing 62 includes a rear portion 74 which is generally cylindrical in shape and which has a central passageway 76 therein and axially extending ribs 75 as an inner cylindrical surface thereof. The rear cylindrical portion 74 is adapted to be received in and mate with the liquid outlet in the upper forward end 20 of the body 14 of the trigger dispensing device 10 as is known in the art. The nose bushing 62 can be similar to the nose bushing disclosed in the Garneau U.S. Pat. No. 4,669,664 and has a structure similar to the outlet end formation disclosed in the Quinn et al U.S. Pat. No. 4,234,128, the disclosure of which is incorporated herein by reference.

As shown, the nose bushing 62 has annular ribs 77 on the rear cylindrical portion 74 which serve as seal rings. Also an alignment flap 78 is provided on the outer surface of the rear cylindrical portion 74 for facilitating proper alignment and insertion of the nose bushing 62 into an opening (hidden from view) in the upper forward end portion 20 of the body 14.

The outlet end portion 64 includes one annular rib 80 over which an inwardly extending annular rib 82 on the inside of the cap portion 42 is snap fittingly received to lock the cap portion 42 onto the outlet end portion 64 of the nose bushing 62 as shown in FIG. 11.

Figure 7:
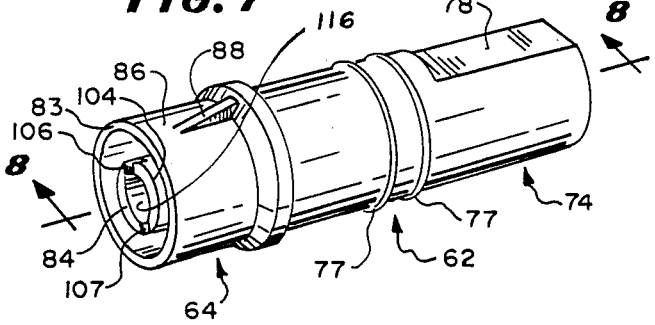
FIG. 7 is a perspective view of a nose bushing member of the foam nozzle assembly.
Figure 8:
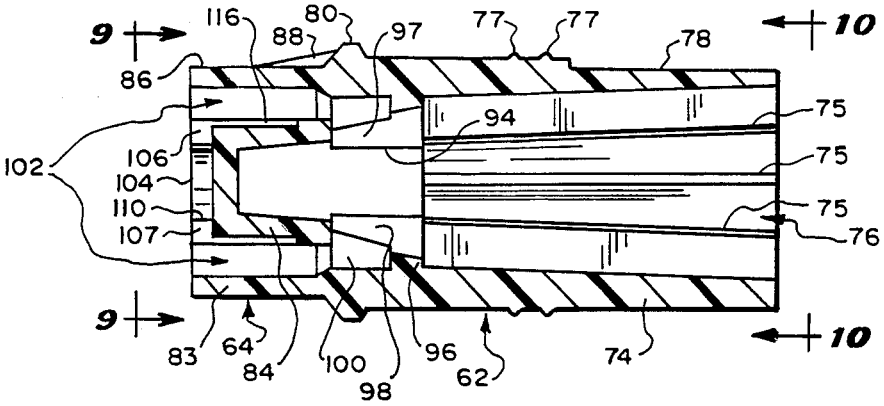
FIG. 8 is a longitudinal axial cross-sectional view of the nose bushing shown in FIG. 7 and is taken along line 8—8 of FIG. 7.

As shown in FIGS. 7 and 8, the outlet end portion 64 of the nose bushing 62 includes an outer cylindrical sleeve 83 and an inner cylindrical sleeve 84. The outer cylindrical sleeve 83 has an outer cylindrical surface 86 on which is formed a rib 88 which is aligned with the flap 78 on the rear cylindrical portion 74 of the nose bushing 62. The rib 88 acts as a stop and limits rotation of the nozzle member 32. In this respect, and with respect to FIG. 4, the cap portion 42 has first and second axially extending ribs 91 and 92 on the inner cylindrical surface 93 thereof which are adapted to engage and abut the rib 88 when the flange 48 is gripped for rotating the nozzle member 32 between the OFF position shown in FIG. 5, where rib 91 engages rib 88, and a FOAM position shown in phantom in FIG. 3, where rib 92 engages rib 88.

Referring now to the description of the nose bushing 62, downstream from the cylindrical passageway 76 is a reduced-in-diameter passageway 94 which is at the beginning of the outlet end portion 64 of the nose bushing 62. Formed in the nose bushing 62, and extending diametrically opposite each other through a middle wall 96 of the nose bushing 62 in the area of the reduced-in-diameter passageway 94, are first and second radially and axially extending slots 97 and 98 which extend from the reduced-in-diameter passageway 94 through the middle wall 96 to an annular slot 100 which communicates with an annular passageway 102 defined between the inner and outer sleeves 83 and 84 in the outlet end portion 64. It will be understood that liquid that is pumped from the body 14 of the trigger operated dispensing device 10 will flow through the passageway 76 through the slots 97 and 98 to the annular slot 100 and then into the annular passageway 102 between the inner and outer sleeves 83 and 84.

With reference to FIGS. 7 and 8, an outer end 104 of the inner sleeve 84 has upper and lower angular slots 106 and 107 therein. These angular slots 106 and 107 are configured so as to direct liquid from the radially outer surface of the inner sleeve 84 tangentially into a swirl cavity 110 and are referred to as tangential slots or passageways 106 and 107 for generating a conical spray pattern 66, 67 subtending an angle of 60. In the preferred embodiment, such slots 106 and 107 angle more toward the center of the cavity 110 and are more radial than tangential to obtain or generate a conical spray 69 subtending an angle of approximately 40°.

Figure 9:
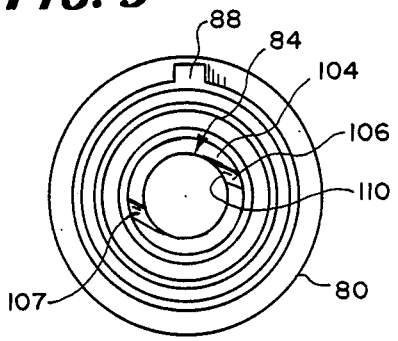
FIG. 9 is a front end view of the nose bushing shown in FIG. 8 and is taken along line 9—9 of FIG. 8.
Figure 10:
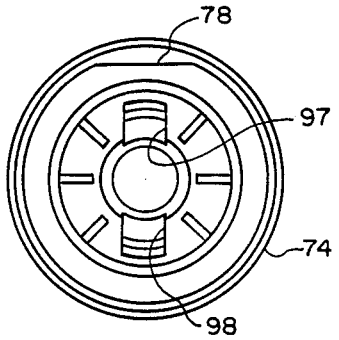
FIG. 10 is a rear end view of the nose bushing shown in FIG. 8 and is taken along line 10—10 of FIG. 8.

As best shown in FIG. 9 and 11, the tangential or radial slot 106 mates with an axially extending slot 116 which is formed in the outer surface of the inner sleeve 84 which extends rearwardly from the outer end 104 of the inner sleeve 84. Likewise, the tangential or radial slot 107 communicates with an axially extending slot 117 which is formed in the outer surface of the inner sleeve 84 and which extends rearwardly from the outer end 104 of the inner sleeve 84.

As shown in FIG. 11, the outer sleeve 83 is received within the cap portion 42 and over a cylindrical valve sleeve 120 which extends rearwardly from the inside wall 50 and which is spaced radially inwardly of outer wall 118 of the cap portion 42. This cylindrical sleeve 120 is received in the annular space 102 and, in the OFF position of the nozzle member 32, will block communication from the radial slots 97 and 98 and the annular slot 100 to the annular passageway 102 into the axial slots 116 and 117 commuting with the tangential slots 106 and 107.

Figure 4:
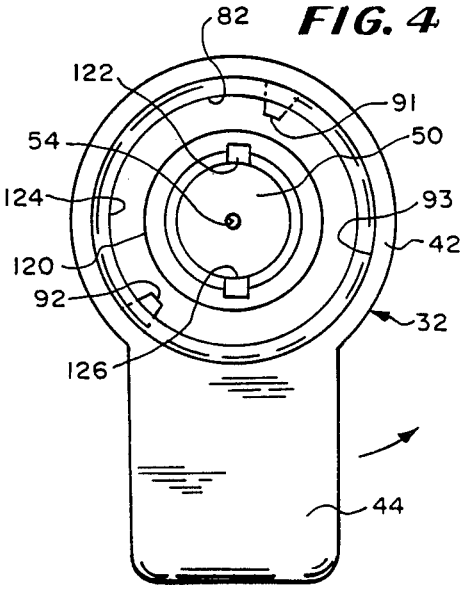
FIG. 4 is a rear end view of the nozzle member shown in FIG. 2 and is taken along line 4—4 of FIG. 2.

However, and with reference to FIG. 4, when the nozzle member 32 is rotated to the position shown in FIG. 5 an axially extending groove 126 formed in inner cylindrical surface 124 of the sleeve 120 will mate with the slot 97 and the axial slot 116 so as to provide a fluid passageway from the reduced-in-diameter passageway 94 through the slot 97 to annular slot 100 and then through the slot 122 in sleeve 120 and into the axial extending slot 116 to the slot 106 so that pressurized liquid can enter the swirl cavity 110 in a tangential flow path. Likewise, another axially extending groove 128 in the inner cylindrical surface 124 of the sleeve 120 then also will be aligned with and in communication with the slot 98 and the axially extending slot 117 communicating with the slot 107.

Thus, when the nozzle member 32 of the foam nozzle assembly 30 is in the "OFF" position, as shown in FIGS. 1, 2, 3 and 11, the sleeve 120 within the cap portion 42 extending rearwardly from the inside wall 50 will close and block off communication between the radial slots 97 and 98 in the nose bushing 62 to the axial slots 116 and 117 in the inner sleeve 84. Then when the nozzle member 32 is rotated to the position shown in phantom in FIG. 3 communication is established to the axial passageways 116 and 117 and from there, of course, to the tangential passageways 106 and, 107.

Pumping of the trigger 22 will cause pressurized liquid to enter the swirl cavity 110 in a path so as to develop a swirling liquid flow which then enters a tapered inlet 129 (FIG. 11) to the orifice 54 resulting in the creation of a spray pattern 69 of liquid exiting the orifice 54 and impinging upon the perforated wall 168 (FIG. 12) of a barrel screen insert 160 (FIG. 12) described below in connection with the description of FIGS. 12–14.

It has been found that a short barrel portion 36, as illustrated in the drawings and described above, having at least one air inlet opening 58 provides a simple and efficient means for creating foam particularly with the barrel screen insert 160 (FIG. 12) inserted in the barrel portion 36 without the need for an elongate barrel.

It will be understood, of course, that the barrel portion 36, although short, must have sufficient length so that a conical spray pattern 66 and 67 will impinge upon the inner cylindrical surface 68 and, in the preferred embodiment, so that a conical spray pattern 69 will impinge, primarily and almost entirely on the rounded back surfaces of ribs 191–194 and 201–203 (FIG. 15) so that foaming can take place in the perforated wall 168 within the barrel portion 36 and in the foam generating chamber 182 resulting in foam exiting the outlet end 34 of the barrel portion 36. Similarly, the air inlet openings 58 must be sufficiently large to admit a sufficient amount of air to effect foaming within the barrel portion 36. Finally, the formation of the orifice 54, the tapered inlet 129 thereto, the swirl cavity 110 and the tangential slots 106 and 107 are constructed and designed so that a desired conical spray pattern is created that will exit the orifice 54 and impinge on the inner surface 68 of wall 56 of the barrel portion 36 in the manner shown in FIG. 11 by dashed lines 66 and 67 or against the ribs 191–194 and 201–203 shown in FIG. 13. For example, in one embodiment the nozzle member 32 had a barrel portion length from the inside wall 50 to the outlet end 34 of approximately 9 mm., a barrel portion inner diameter of approximately 6 mm., an orifice 54 diameter of approximately 0.6 mm., a tapered inlet 129 (FIG. 11) round having a radius of approximately 1.2 mm. and air inlet openings 58 having an approximate cross-section of $1.5 \times 3.0$ mm.

Figure 12:
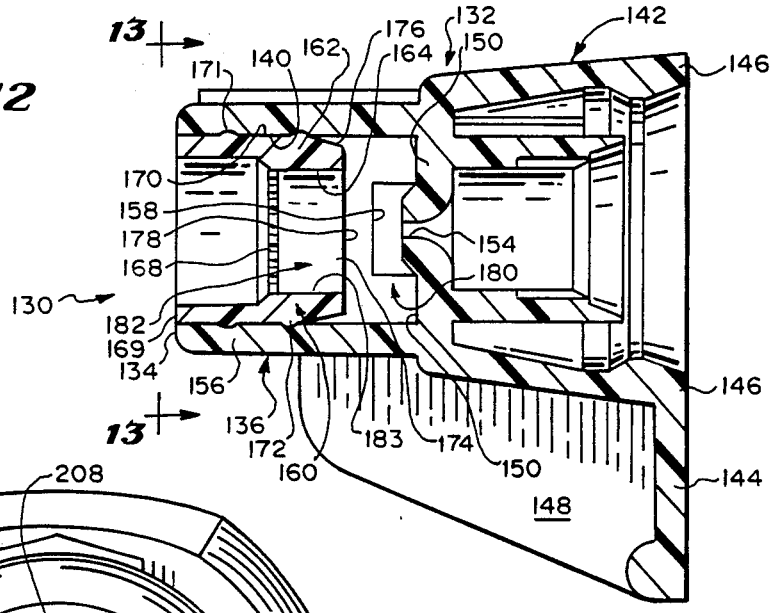
FIG. 12 is a longitudinal axial cross-sectional view of a nozzle member, similar to the nozzle member shown in FIG. 11 and of a barrel screen insert member mounted in an outer, short barrel portion of said nozzle member, constructed according to the teachings of the present invention.

In FIG. 12, there is illustrated a cross-section of a nozzle assembly 130 including a nozzle member 132 similar to the nozzle member 32 as shown in FIG. 11. The sectional view of the nozzle assembly 130 differs from the sectional view of the nozzle assembly 30 shown in FIG. 11 by excluding the showing of a nose bushing on which the nozzle member 132 is mounted.

The nozzle member 132 has an outlet end 134 at the outlet of a short barrel portion 136 of the nozzle member 132. The nozzle member 132 is substantially identical to the nozzle member 32 and has a smooth, generally cylindrical, inner surface 140 within the short barrel portion 136. The nozzle member 132 further includes a cap portion 142 which has a generally triangular outer configuration as shown in FIG. 13. Depending from the cap portion 142 is a radial flange 144 which extends from and is integral with the rear margin 146 of the cap portion 142. An axially extending flange 148 extends axially forwardly from the radially extending flange 144.

The nozzle member 132 further has an interior wall 150 extending transversely of the nozzle member 132. The interior wall 150 has an orifice 154 extending therethrough.

The short barrel portion 136 is defined by a cylindrical wall 156 which has at least two opposed side air inlet openings 158 one of which is shown in FIG. 12.

To assist and facilitate the foaming of liquids having different viscosities, a barrel screen insert 160 is mounted within the short barrel portion 136 and is press-fitted within and against the inner surface 140 of the cylindrical wall 156 of the short barrel portion 136. The barrel screen insert 160 includes a hollow cylindrical body 162 having therein an inner cylindrical cavity 164 and an outer cylindrical cavity 166 separated by a perforated wall 168. As shown, the inner cylindrical cavity 164 is of smaller diameter than the outer cylindrical cavity 166.

Preferably, and as shown in FIG. 12, an outer end 169 of the barrel screen insert 160 is positioned flush with the outer end 134 of the short barrel portion 136.

The barrel screen insert 160 has a generally cylindrical outer surface 170 with an outer diameter equal to approximately the same diameter as the diameter of the inner cylindrical wall surface 140 of the short barrel portion 136.

To facilitate an interference fit of the barrel screen insert 160 into the short barrel portion 136, the barrel screen insert 160 has two spaced-apart annular ribs 171, 172 on the outer surface 170 thereof which are deformed when the barrel screen insert 160 is press-fitted into the short barrel portion 136.

To facilitate insertion of the barrel screen insert 160 into the short barrel portion 136, an inner end portion 174 thereof has a beveled surface 176.

As shown, the length of the barrel screen insert 160 is less than the length of the short barrel portion 136 such that an inner end 178 of the insert 160 is spaced forwardly of the interior wall 150 and forward of the air inlet openings 158. In this way, a short cylindrical space 180 is defined between the interior wall 150 and the inner end 178 of the barrel screen insert 160.

The orifice 154 opens into this space as do the side air inlet openings 158. The inner cylindrical cavity 164 together with the short cylindrical space 180 form and define a foam generating chamber 182 in which foam is created by the conical spray of liquid from the orifice 154 into the chamber 182. The spray impinges primarily upon the perforated wall 168, although some of the spray may also impinge upon cylindrical side wall surface 183 of the inner cylindrical cavity 164.

The liquid sprayed into the foam generating chamber 182 mixes with air within the foam generating chamber 182 and forms foam. Successive strokes of the trigger 22 result in the generation of further foam which then flows through the openings or perforations 184 in the screen 168.

The foam passing through the perforated wall 168 enters into the outer cylindrical cavity 166 which defines a foam accumulation chamber 166.

Figure 13:
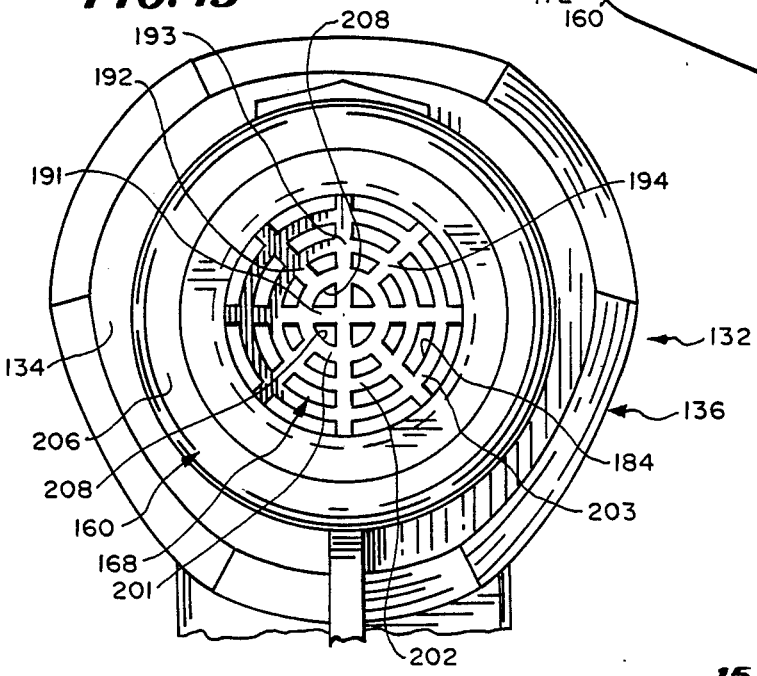
FIG. 13 is a front elevational view of the nozzle assembly shown in FIG. 12 and is taken along line 13—13 of FIG. 12.
Figure 14:
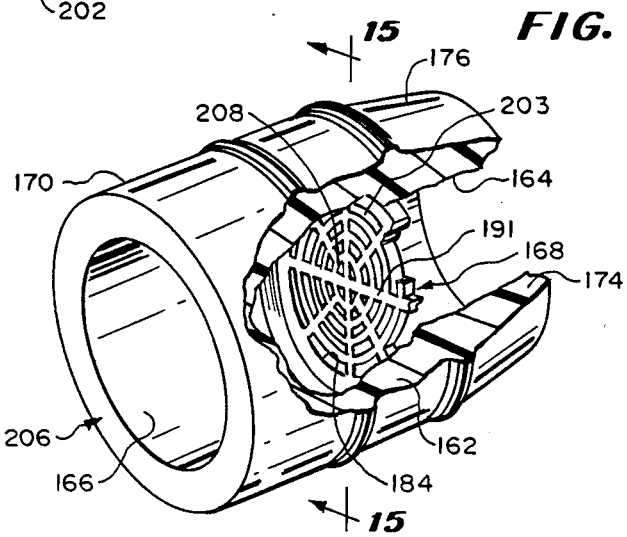
FIG. 14 is a perspective view, with portions broken away, of the barrel screen insert shown in FIG. 12.

As shown in FIGS. 13 and 14, the perforated wall 168 has openings 184 therein in the form of partially annular slots 184 which are arranged as circular segments such that the area between the circular segments define four intersecting diameter ribs 191–194 equally arcuately spaced from each other and three generally concentric circular ribs 201–203 extending between and integral with the diameter ribs in the wall 150.

Figure 15:
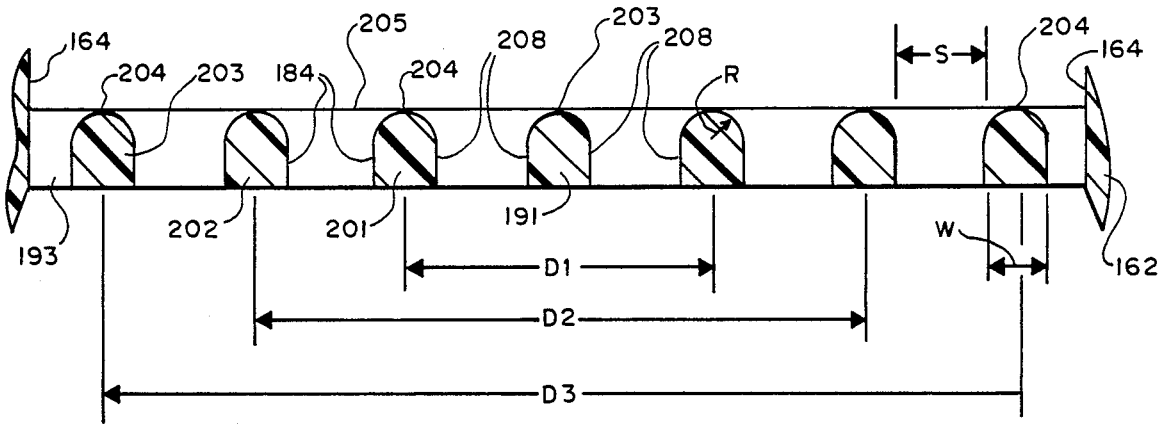
FIG. 15 is a fragmentary sectional view taken along line 15—15 of FIG. 14 through the perforated wall and to one side of a diameter rib therein.

FIG. 15 shows an enlarged cross-section through the perforated wall 168 and along a horizontal line to the side of diameter rib 193. From this cross-section it will be apparent that the circular ribs 201, 202 and 203 all have a rounded edge 204 facing into the inner cavity 164. The rounded edge 204 of each rib 201–203 has a radius R which can be between 0.05 and 0.15 millimeters dependent on the thickness W of the circular ribs 201–203 and the spacing S between concentric rib portions in an arcuate slot 184. Typically, the ratio between the radius R and the spacing S is 1:3. Thus, in one preferred embodiment the radius R is 0.1 millimeter. The spacing or width S of the arcuate slots 184 is 0.3 millimeters and the width W of the ribs is 0.2 millimeters.

In one preferred embodiment of the perforated wall 168, the diameter D1 of the first circular rib 201 is 1.25 millimeters, the diameter D2 of the second circular rib 202 is 2.25 millimeters and the diameter D3 of the third circular rib 203 is 3.25 millimeters.

The diameters ribs 191, 192, 193 and 194 also have a rounded inner edge 205 facing into the inner cavity 164. These ribs, in a preferred embodiment, also have a thickness of 0.2 millimeters and a round with a radius R of 0.1 millimeters.

Additionally, and as shown, the diameter ribs 192 and 194 do not extend inwardly of the first circular rib 201 so that four pie-shaped slots 208 are formed at the center of the perforated wall 168.

Empirical tests have shown that the contour of the back edge of each of the ribs 191–194 and 201–203 facing into the inner cavity 164, as well as the distance s between the circular ribs, significantly affect the amount and type of foam generated and the dispensing of the foam. In this respect, with a flat edge instead of a rounded edge, a good foam generation is accomplished. However, flow of the foam from the foam generating chamber to the foam accumulation chamber is impeded.

On the other hand, providing the back edge of each of the ribs with an inverted V shape, while facilitating the flow of liquid and foam from the foam generating chamber to the foam accumulating chamber, reduces the amount of foam generated and an undesirable amount of liquid is passed through to the foam accumulation chamber.

Of course, it is clear that the smaller the spacing S the harder it is for the foam to flow through the perforated wall 168 into the foam accumulating chamber. Of course, on the other hand, the larger the spacing S the less surface of back edges of ribs are provided on which a spray can impinge to create foam. Thus, there are trade offs and as noted above empirical tests have shown that providing the ribs 191–194 and 201–203 with rounded back edges and providing the radius R of the round in a ratio of approximately 1:3 to the spacing S between adjacent circular ribs (R:S) provides good results in the generation and ejection of foam. Although a ratio of the radius R of the round of each back edge to the spacing S between adjacent circular ribs of 1:3 has been found to produce good results, it is to be understood that this ratio can be varied somewhat upwardly and downwardly and still provide adequate results, such as between a ratio of 1:1 and 1:10.

It will be apparent from the foregoing description that the foam nozzle assembly 130, including a nose bushing 62, a nozzle member 132 with an outer short barrel portion 136 and a barrel screen insert 160 in the short barrel portion 136, of the present invention has a number of advantages some of which have been described above and others of which are inherent in the invention. Also, it will be apparent that modifications can be made to the foam nozzle assembly of the present invention without departing from the teachings of the invention. Accordingly, the scope of the present invention is only to be limited as necessitated by the accompanying claims.

I claim:

1. A foam nozzle assembly mounted to a trigger sprayer and comprising an outer barrel portion defining a foam generating chamber into which liquid is ejected in a conical spray from an orifice in a back wall of the foam generating chamber, the cone of the spray subtending a predetermined angle, and a perforated wall which is located in said outer barrel portion and which is spaced forwardly of said back wall having said orifice from which the conical spray is ejected, said perforated wall having ribs and slots therein and the back edges of the portions of said ribs between slots being rounded to provide a surface upon which the conical spray can impinge and be deflected in different directions to mix with air in the foam generating chamber to create foam, the rounded back edge of each of said ribs being defined by a generally circular round having a given radius R.

2. The foam nozzle assembly and trigger sprayer of claim 1 wherein said trigger sprayer comprises a body adapted to be coupled to a container having liquid therein, a trigger operated pumping system mounted in the body, a movable trigger associated with the body and engaging the pumping system, a liquid inlet in the body coupling the container with the pumping system and a liquid outlet from the body coupled to the pumping system, and wherein said nozzle assembly comprises (a) a unitary one piece nose bushing having an outlet end portion including means for establishing a desired outlet flow, (b) a unitary one piece nozzle member including (1) said barrel portion (2) an inner cap portion received over and mounted on said bushing outlet end portion and (3) said back wall which is situated between said cap portion and said outer barrel portion, said back wall having said orifice therein and said outer barrel portion having air inlet means in the wall thereof near said back wall, and (c) a barrel screen insert situated within said outer barrel portion and including (1) a hollow cylindrical body having an outer cavity and an inner cavity therein and (2) said perforated wall which is situated between said inner and outer cavities, said outer barrel portion and said orifice being constructed and designed such that when said means for establishing said outlet flow is in communication with said orifice, the spray pattern from said orifice, generated upon operation of said pumping system, will impinge primarily upon said perforated wall, mix with air entering into said outer barrel portion and said inner cavity of said barrel screen insert through said air inlet means and form foam which is dispensed through said perforated wall into said outer cavity of said cylindrical body of said barrel screen insert which defines therein a foam accumulation chamber, said inner cavity and part of the interior of said outer barrel portion defining said foam generating chamber.

3. The foam nozzle assembly of claim 2 wherein said outlet end portion of said nose bushing includes inner and outer sleeves, and said nose bushing has a cylindrical passageway therein including a reduced-in-diameter portion, at least two opposed annular slots extending through a middle wall of the bushing located outwardly of said reduced-in-diameter cylindrical passageway to an annular slot in said nose bushing for communicating the reduced-in-diameter passageway with the annular slot, and an annular passageway defined between said inner and outer sleeves of said outlet end portion communicating with said annular slot.

4. The foam nozzle assembly of claim 3 wherein said inner sleeve has opposed axially extending slots therein and an outer end of said inner sleeve has a cylindrical cavity and radial slots extending from the outer surface to the cylindrical cavity and oriented to direct liquid at a desired angle into the cylindrical cavity.

5. The foam nozzle assembly of claim 4 wherein said nozzle member includes a valve sleeve extending rearwardly from said inside wall of said nozzle member within and spaced radially inwardly from the outer wall of said cap portion, said valve sleeve being adapted to be received in the annular space between the inner and outer sleeves in the outlet end portion of said nose bushing thereby to block communication from the radial slots and annular slot in said nose bushing to said axially extending slots and tangential slots in the outer surface and end surface of said inner sleeve of said bushing outlet end portion.

6. The foam nozzle assembly of claim 5 wherein said valve sleeve within said cap portion has two axially extending slots formed in the inner cylindrical surface thereof which, when the nose member is rotated to said FOAM position, communicate with the opposed radial slots within the middle wall of said nose bushing and with the axially extending slots in the outer surface of the inner sleeve of said bushing outlet end portion.

7. The foam nozzle assembly of claim 6 wherein said outer sleeve in said outlet end portion of said nose bushing has a rib thereon forming a stop and said cap portion has formed on the inner cylindrical surface thereof two axially extending ribs which are adapted to engage and stop against said axially extending rib on said bushing outlet end portion.

8. The foam nozzle assembly of claim 2 wherein said nozzle member and said outlet end of said nose bushing have registrable cooperating swirl establishing means and said nozzle member is rotatable on said bushing outlet end portion between an OFF position closing off said swirl establishing means and a FOAM position where said swirl establishing means are in communication with said orifice.

9. The foam nozzle assembly of claim 8 including thumb or finger engaging means extending from said nozzle member and adapted to be engaged by a thumb or finger for rotating the nozzle member between said OFF position and said FOAM position.

10. The foam nozzle assembly of claim 8 wherein said nozzle member has indicia on the upper surface thereof indicating the OFF position of the nozzle member.

11. The foam nozzle assembly of claim 10 wherein said OFF position indicating indicia is the word "STOP" formed on the outer cylindrical surface of said barrel portion of the nozzle member.

12. The foam nozzle assembly of claim 8 wherein said nozzle member has on a side thereof foam indicating indicia which will face upwardly when the nozzle member has been rotated to the FOAM position.

13. The foam nozzle assembly of claim 12 wherein said foam indicating indicia is in the form of a conical spray pattern and small bubbles formed on the outer cylindrical surface of the cap portion of the nozzle member.

14. The foam nozzle assembly of claim 2 wherein said air inlet means includes at least two air inlet openings in the wall of said barrel portion.

15. The foam nozzle assembly of claim 14 wherein said air inlet openings are formed in opposite sides of the barrel portion diametrically opposite each other.

16. The foam nozzle assembly of claim 14 wherein said air inlet openings have a cross section of approximately 3.0 mm. × 1.5 mm.

17. The foam nozzle assembly of claim 2 wherein said barrel portion has an inner diameter of approximately 6.0 mm. and a length of approximately 9 mm.

18. The foam nozzle assembly of claim 2 wherein said orifice has a diameter of approximately 0.6 mm.

19. The foam nozzle assembly of claim 2 wherein said inner cavity of said barrel screen insert has a smaller diameter than the outer cylindrical cavity.

20. The foam nozzle assembly of claim 2 wherein said cylindrical body portion of said barrel screen insert has at least one annular rib on the outer surface thereof to facilitate an interference press-fit of the barrel insert member into said short barrel portion.

21. The foam nozzle assembly of claim 2 wherein said barrel screen insert has a beveled surface at an inner end thereof to facilitate insertion of said barrel screen insert into said short barrel portion.

22. The foam nozzle assembly of claim 1 wherein said perforated wall has arcuate, partially circular slot segments which define therebetween the outline of at least two intersecting equally arcuately spaced apart diameter ribs and at least two concentric circular ribs.

23. The foam nozzle assembly of claim 22 wherein said diameter ribs and said concentric circular ribs have rounded back edges facing away from said outer barrel portion.

24. The foam nozzle assembly of claim 22 wherein said perforated wall includes three concentric circular ribs, the first circular rib having a diameter of approximately 1.25 millimeters, the second circular rib having a diameter of approximately 2.25 millimeters and the third circular rib having a diameter of approximately 3.25 millimeters.

. 25. The foam nozzle assembly of claim 22 wherein the width of each circular rib and each diameter rib is approximately 0.2 millimeters.

26. The foam nozzle assembly of claim 22 wherein said back edges of said ribs have a circular round defined by a radius R equal to 0.1 millimeters, the radial spacing across said circular slot segments between adjacent concentric circular ribs is 0.3 millimeters and a center area of said perforated wall is defined by four quarter pie shaped slots located between the inner circular ribs and the diameter ribs.

27. The foam nozzle assembly of claim 1 wherein the width of each slot is defined as S, and the radius R is in a ratio to the slot width S, R:S, of between approximately 1:2 and 1:4.

28. The foam nozzle assembly of claim 1 wherein said ratio, R:S is 1:3.

29. The foam nozzle assembly of claim 1 wherein said orifice is constructed so that the cone of said conical spray subtends an angle of approximately 40 degrees and impinges primarily upon said perforated wall.

* * * * *